US005303768A

United States Patent [19]

Alario et al.

[11] Patent Number: 5,303,768

[45] Date of Patent: Apr. 19, 1994

[54] CAPILLARY PUMP EVAPORATOR

[75] Inventors: Joseph P. Alario; Fred Edelstein, both of Hauppauge; Robert L. Kosson, Massapequa; Maria Liandris, Farmingdale, all of N.Y.

[73] Assignee: Grumman Aerospace Corporation, Bethpage, N.Y.

[21] Appl. No.: 18,536

[22] Filed: Feb. 17, 1993

[51] Int. Cl.[5] ..... F28D 15/02

[52] U.S. Cl. ..... 165/104.26; 122/366; 165/907

[58] Field of Search ..... 165/104.26, 907; 122/366

[56] References Cited

U.S. PATENT DOCUMENTS 4,869,313 9/1989 Fredley ..... 165/104.26
4,883,116 11/1989 Seidenberg et al. ..... 165/104.26
4,934,160 6/1990 Mueller ..... 165/104.26
5,016,705 5/1991 Bahrle et al. ..... 165/104.26

*Primary Examiner*—Albert W. Davis, Jr.
*Attorney, Agent, or Firm*—Pollock, Vande Sande & Priddy

[57] ABSTRACT

An improved capillary pumped loop evaporator includes circumferential grooves formed in the outer heat exchanger portion of the evaporator. The grooves open to the interface existing between the heat exchanger and a centrally positioned tubular wick. Axially extending vapor channels are formed in the wick and also open onto the interface. The circumferential grooves continuously communicate with the interface and provide a vapor escape to the vapor channels which direct vapor passage from the evaporator. By shortening the vapor path from the interface, a thinner vapor barrier is possible at the interface which results in more efficient heat transfer.

9 Claims, 3 Drawing Sheets

CAPILLARY PUMP EVAPORATOR

FIELD OF THE INVENTION

The present invention relates to thermal exchange devices, and more particularly to a capillary pump evaporator designed to operate in a thermal control system.

BACKGROUND OF THE INVENTION

Space vehicles customarily employ heat pipes for achieving heat transfer from temperature-sensitive components such as electronic circuits. Heat pipes are passive devices with no moving parts and are therefore very reliable. However, because the wick in a heat pipe must be continuous and extend over its entire length between the evaporator and condenser, fluid pressure drops become excessive with power levels beyond a few kilowatts. For larger loads, mechanically pumped two-phase thermal control systems (TCS) are ideal and are considered for installations which are manned. This is due to the fact that the systems use mechanical components such as pumps and valves, which consume vehicle electric power and require maintenance and redundancy to achieve long orbital life.

In the case of space platforms, power requirements (5 to 15 kw) are too large to be handled by conventional heat pipes and too small to require a mechanically pumped two-phase loop. The prior art includes a device known as a capillary pumped loop (CPL) which has been recently developed for NASA by the OAO Corporation of Maryland. Such a device could satisfy the needs of moderate power space platforms. The CPL utilizes a very fine wick structure to provide a high pumping potential. Because the wick is only located in the evaporator, the rest of the loop can be made using simple (unwicked) tubing so that the system pressure drop will be small. An electrically heated accumulator is needed to allow loop operation at the desired temperature. Thus, the CPL offers a reliable moderate power capability thermal control system that is passive, i.e. having no moving parts, and operates with the same vibration-free characteristic as conventional heat pipes.

BRIEF DESCRIPTION OF THE PRESENT INVENTION

The present invention is directed to an improvement or optimization of the existing CPL design. The invention incorporates a fine wicking material, such as the prior art. However, the present invention utilizes axial slots formed in the wicking material which communicate with circumferential grooves formed by threading the cylindrical tube in the heat exchanger, providing improved vapor venting paths so that the vapor barrier is minimized at the thermal exchange interface within the evaporator. The utilization of such a circumferential groove structure greatly increases the input heat flux capability of the evaporator and lowers the thermal resistance of the evaporator.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
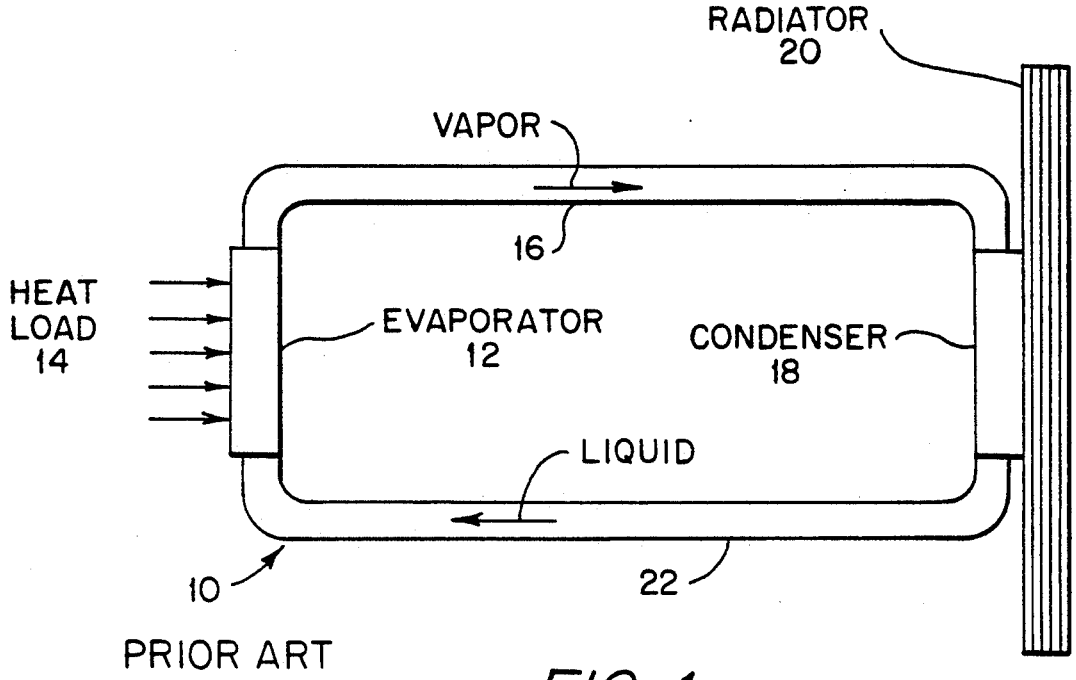
FIG. 1 is a schematic illustration of a prior art capillary pumped loop.

Prior to a discussion of the particular improvement constituting the present invention, FIGS. 1 and 2 will be discussed which relate to the previously mentioned prior art capillary pumped loop. In FIG. 1 the loop is generally indicated by reference numeral 10 and is seen to include an evaporator 12 which is subjected to a heat load 14. Liquid in the evaporator absorbs the heat and becomes vaporized, the resulting vapor traveling along loop section 16 to a condenser 18. Heat exchange to a radiator 20, or other suitable heat sink, causes a phase change of the vapor to the liquid state. This liquid is returned through loop section 22 to the evaporator 12 for continual recycling.

Figure 2:
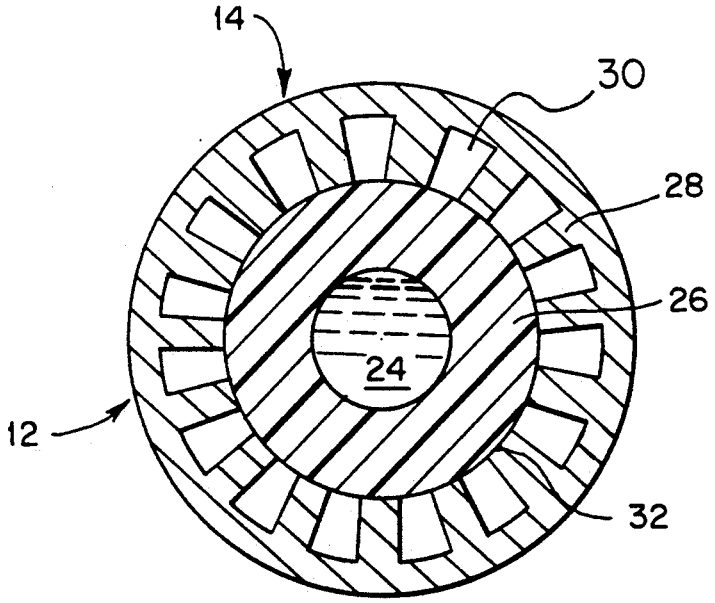
PRIOR ART FIG. 2
FIG. 2 is a cross-sectional view of the prior art evaporator existing in the loop of FIG. 1.

FIG. 2 illustrates a cross section of the prior art evaporator 12. A cylindrical wick 26 is seen to enclose a working liquid 24, typically ammonia. The wick is fabricated from an open cell material, such as one commercially available under the trademark POREX. An outer cylindrical heat exchanger 28, typically fabricated from aluminum tubing, has a plurality of axially extending vapor channels 30 formed therein.

Liquid flowing through the wick encounters heat 14 conducted through the heat exchanger 28 thereby causing a phase change to the vapor state along interface 32 which exists between the outer surface of wick 26 and the inner surface of the heat exchanger 28. The vapor is collected in the channels 30 and is collected in the loop section 16 (FIG. 1) for circulation through the loop.

The present invention is an improvement over the discussed prior art approach and is essentially directed to the minimization of the length of the vapor flow path between the interface and the vapor channels. This decreases the thickness of a vapor barrier at the interface; and as a result, there is an increase in the input heat flux capability of the evaporator, or a decrease in thermal resistance for the same input heat flux.

Figure 3:
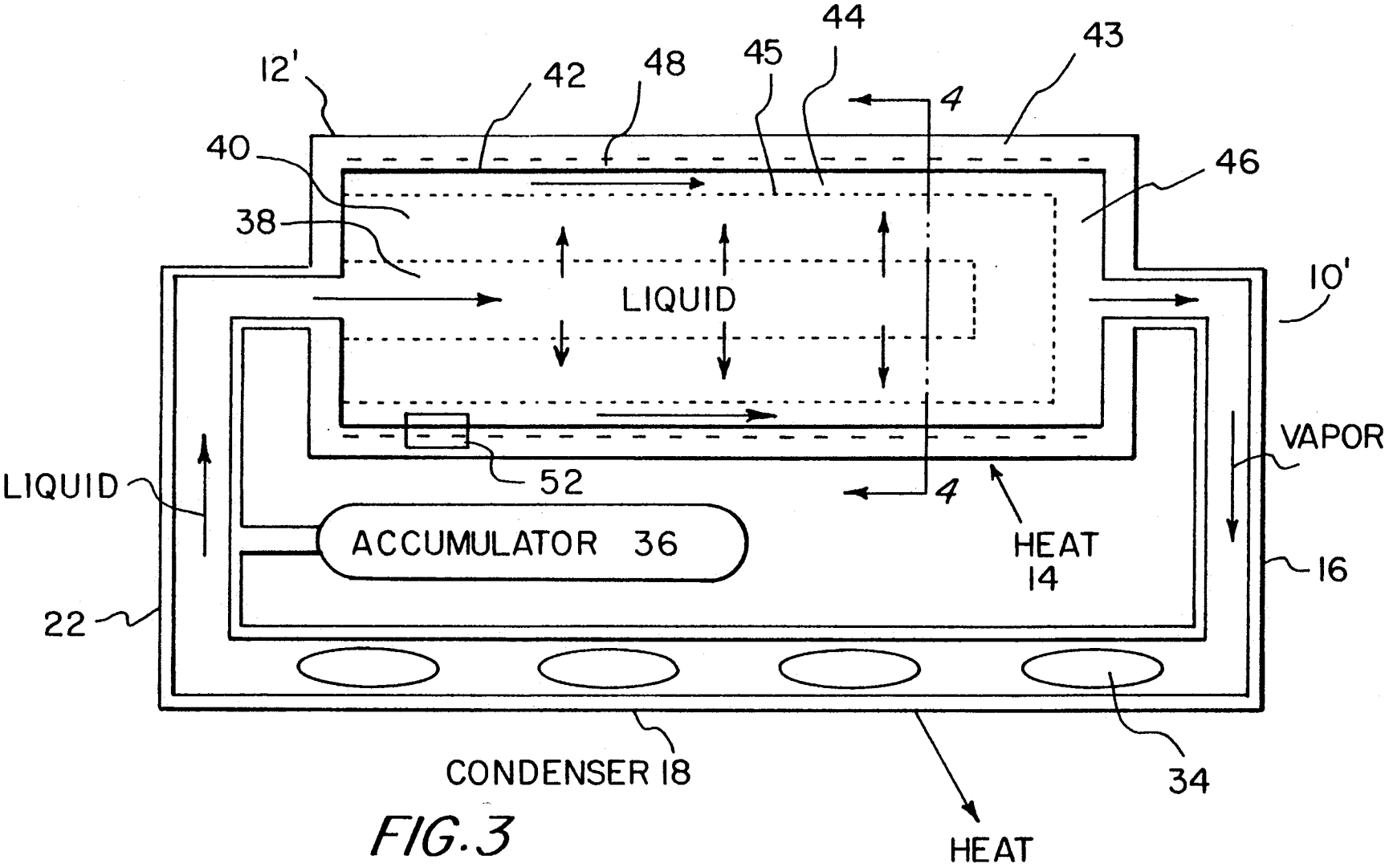
FIG. 3 is a diagrammatic loop of the present capillary pump loop.

FIG. 3 illustrates the present invention as installed in a capillary pump loop (CPL) 10' of the type previously discussed in connection with FIG. 1. Accordingly, similarly constructed portions of the loop are identically numbered. In FIG. 3 condensate 34 forming in the condenser 18 of the loop produces working liquid which is introduced into the evaporator 12' which forms the heart of the present invention.

As in the case of most CPLs, an electrically heated accumulator 36 is needed to regulate the vapor pressure which allows loop operation at the desired corresponding temperature.

Figure 4:
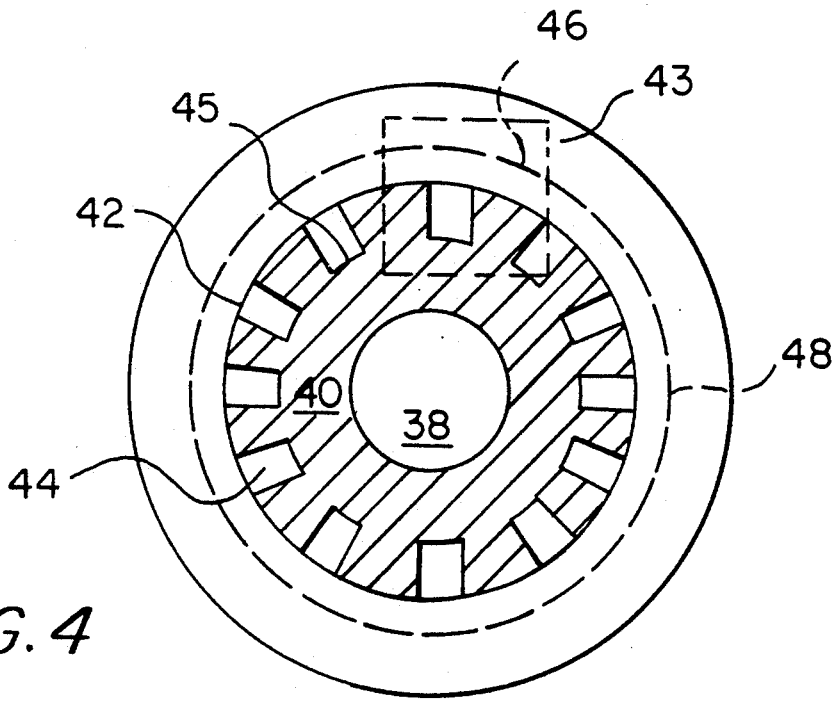
FIG. 4 is a cross-sectional view of the evaporator as employed in the present invention.

FIG. 4 illustrates a cross-sectional view of the present evaporator which may be compared with the prior art cross section of FIG. 2. A central opening 38 is again axially formed through the wick 40 fabricated from the same uniformly porous, permeable, open-celled polyethylene thermoplastic foam, such as POREX, mentioned in connection with the prior art. The wicking material offers a small pore size (typically 10 micron radius) and high permeability for maximum capillary pumping capacity and minimum pressure drop, respectively. These characteristics in a wicking material offer maximum heat transfer efficiency in a CPL application.

Figure 5:
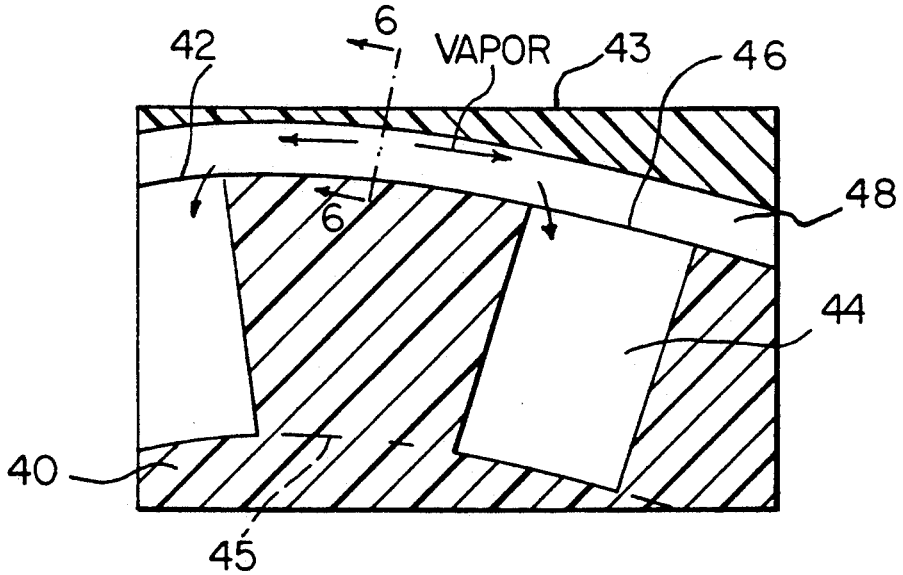
FIG. 5 is a partial sectional view of an axially grooved wick, as shown in FIG. 4; it also illustrates vapor flow between the axial grooves of the evaporator wick and circumferential grooves appearing in the outer tube of the evaporator.

A first distinction of the present evaporator design as compared with the present invention relates to the formation of vapor channels 44 within the wick 40 as opposed to within the cylindrical heat exchanger 43. An exploded detailed view of the vapor channel is shown in FIG. 5 and generally indicated by reference numeral 46. The depth of each vapor channel is defined between the outer surface 42 of wick 40 and the radius 45 (see FIG. 4).

Figure 6:
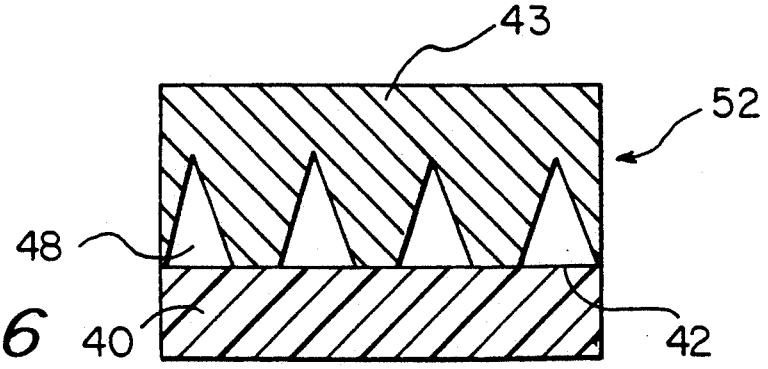
FIG. 6 is a partial sectional view of circumferential grooves existing in an outer metal tube of the evaporator shown in FIG. 4.

The present invention includes threaded circumferential grooves 48 within the heat exchanger 43, the grooves being threaded along the entire length of wick 40 as shown in FIG. 3. The circumferential groove section generally indicated by reference numeral 52 (FIG. 3) is shown in exploded greater detail in FIG. 6. As will be appreciated from that figure, the circumferential grooves open on to the interface 42 existing between the outer surface of the wick 40 and the inner surface of heat exchanger 43. The circumferential grooves provide a continuous escape passage around the interface as indicated in FIG. 6. As with the prior art, vapor is generated at that portion of the interface 42, where the heat exchanger 43 is in close contact with the wick 40. At spaced intervals, the vapor channels 44, existing in the wick 40, collect vapor from the circumferential grooves 48. As indicated in FIG. 3, the right end of evaporator 12' has a vapor header 46 for connecting the exiting vapor to the vapor loop section 16 of the CPL 10'.

Accordingly, in operation of the CPL 10', liquid ammonia saturates the pores of wick 40, and heat 14 entering the heat exchanger 43 vaporizes the liquid continuously as it emerges from the wick. Vaporization occurs at the aluminum heat exchanger POREX interface 42 while liquid is continuously pumped by the wicking material to replenish the depleted liquid at the interface.

Vapor flows into the circumferential grooves 48 of the heat exchanger and then into the axial grooves of the vapor channel 44 in the wick where it travels axially along the evaporator and finally exits to vapor header 46. From there, the vapor travels through the vapor loop section 16 until it becomes condensed in condenser 18 for return to the evaporator as a liquid through loop section 22. The capillary pressure difference across the wick ensures continuous circulation of the fluid.

In a typical evaporator the inner surface of the heat exchanger has circumferential grooves 0.003" wide by 0.006" deep at a pitch of 30.5 grooves/inch and 40 equally spaced axially extending grooves with grooves cut 0.030 inch wide and 0.170 inch deep. The evaporator is assembled to create a tight fit between the aluminum and POREX sections. The present invention is particularly well adapted for operation on outer space platforms with moderate power requirements. However, other uses of the present evaporator would be unmanned satellites and payloads attached to manned space stations.

As will be appreciated from the foregoing discussion, the present invention offers an improvement over existing capillary pumped loops with a design which reduces evaporator pressure drop with an increase of transport capability. Further, reduced temperature drop across the evaporator results in more efficient heat transfer.

It should be understood that the invention is not limited to the exact details of construction shown and described herein for obvious modifications will occur to persons skilled in the art.

We claim:

1. In a capillary pump loop, an evaporator comprising:

a tubular wick for containing working liquid flow centrally therein, the body of the wick being saturated with the liquid;

a tubular heat exchanger for tightly receiving the wick, the heat exchanger being subjected to ambient heat which causes liquid to undergo phase transformation to vapor at an interface between an outer surface of the wick and an inner surface of the heat exchanger;

a threaded groove circumferentially extending over the inner surface of the heat exchanger, about an axis of the heat exchanger, the groove opening onto the interface between the wick and the heat exchanger; and axially oriented vapor channels extending along the entire length of the wick and opening onto the interface, wherein the channels intersect the circumferential grooves to form a shortened vapor outlet path from the interface.

2. The evaporator set forth in claim 1 wherein the tubular wick is fabricated from uniformly porous, permeable, open celled polyethylene thermoplastic foam.

3. The evaporator set forth in claim 1 wherein the wick is fabricated from a porous, permeable form of conductive metal.

4. The evaporator set forth in claim 1 together with a vapor header serving as a plenum for the vapor exiting the channels in the heat exchanger.

5. A capillary pump loop comprising:

an evaporator subjected to ambient heat;

a first tube section for transporting vapor away from the evaporator;

a condenser connected in line with the first tube section for conducting heat from the loop and changing the vapor to the liquid phase;

a second tube section for returning liquid to an inlet of the evaporator;

the evaporator including (a) a tubular wick for containing working liquid flowing centrally therein, the body of the wick being saturated with the liquid;

(b) a tubular heat exchanger for tightly receiving the wick, the heat exchanger being subjected to ambient heat which causes liquid to undergo phase transformation to vapor at an interface between an outer surface of the wick and an inner surface of the heat exchanger;

(c) a threaded groove circumferentially extending over the inner surface of the heat exchanger, about an axis of the heat exchanger, the groove opening onto the interface between the wick and the heat exchanger; and (d) axially oriented vapor channels extending along the entire length of the wick and opening onto the interface, wherein the channels intersect the grooves to form a shortened vapor outlet path from the interface.

6. The loop set forth in claim 5 wherein the evaporator tubular wick is fabricated from uniformly porous, permeable, open celled polyethylene thermoplastic foam; and further wherein the wick is fabricated from a porous, permeable form of conductive metal.

7. The loop set forth in claim 5, together with a vapor header serving as a plenum for the vapor exiting the channels in the heat exchanger.

8. The loop set forth in claim 6 wherein the evaporator tubular wick is fabricated from POREX thermoplastic foam; and further wherein the heat exchanger is fabricated from aluminum.

9. The loop set forth in claim 6 wherein the wick is fabricated from a porous, permeable form of conductive or non-conductive material, and further wherein the heat exchanger is fabricated from alternate high strength tubing materials such as stainless steel and titanium.

* * * * *